US006852021B1

(12) United States Patent
Ali et al.

(10) Patent No.: US 6,852,021 B1
(45) Date of Patent: Feb. 8, 2005

(54) IMPLEMENT FOR ABRADING AND METHOD OF MAKING SAME

(75) Inventors: Terry Ali, Fairborn, OH (US); Christopher Ali, Fairborn, OH (US); Phillip Glenn Ali, Fairborn, OH (US)

(73) Assignee: ALI Industries, Inc., Fairborn, OH (US)

( * ) Notice: Subject to any disclaimer, the term of this patent is extended or adjusted under 35 U.S.C. 154(b) by 70 days.

(21) Appl. No.: 10/372,425

(22) Filed: Feb. 21, 2003

(51) Int. Cl.[7] ..... B24D 15/04

(52) U.S. Cl. ..... 451/533; 451/526; 451/523; 451/503

(58) Field of Search ..... 451/526, 533, 451/538–540, 503, 523; 51/295, 809; 264/241–279

(56) References Cited

U.S. PATENT DOCUMENTS 5,863,243 A * 1/1999 Ali ..... 451/503
5,919,549 A * 7/1999 Van et al. ..... 428/141
5,942,015 A * 8/1999 Culler et al. ..... 51/295
6,062,966 A 5/2000 Ali et al.
6,179,887 B1 * 1/2001 Barber, Jr. ..... 51/298
6,267,658 B1 7/2001 Ali et al.
6,287,184 B1 * 9/2001 Carpentier et al. ..... 451/526
6,352,567 B1 * 3/2002 Windisch et al. ..... 51/298
6,509,084 B2 * 1/2003 Sturtevant et al. ..... 428/141

* cited by examiner

*Primary Examiner*—Lee D. Wilson
*Assistant Examiner*—Anthony Ojini
(74) *Attorney, Agent, or Firm*—R. William Graham

(57) ABSTRACT

A method of making an abrading implement includes the steps of disposing a porous member for aiding in abrasion adjacent a first surface within a mold and supplying two reactive liquid components into the mold in a manner in which the two materials enter onto a second surface of the mold opposing the first surface, whereupon a reaction between the components form a raw implement of structural foam which is bonded to the porous member. Subsequent the reaction, the raw implement is removed from the mold and cut, preferably sawn, in a manner to provide an abrasive implement having a surface portion the foam exposed from the cut to aid in gripping the same by one's hand. An abrading implement is also provided by the method.

13 Claims, 9 Drawing Sheets

IMPLEMENT FOR ABRADING AND METHOD OF MAKING SAME

BACKGROUND OF THE INVENTION

1. Field of the Invention

The invention relates generally to the field of molding manufacturing. More particularly, but not by way of limitation, the present invention relates to improvements in abrading implements and method of making the same.

2. Related Art

There exist a variety of styles of tools for abrading, such as sanding blocks or scrubbing pads and methods of making the same. For example, sanding blocks are generally integrally formed in a mold shaped to produce a finished piece of rubber which has a pair of split ends configured with retention surfaces therein, such a plurality of nails which together are used to retain a sheet of sandpaper. The ends must be pried apart such that the nails are removed from the retention surfaces so that ends of a piece of sandpaper can be disposed between the block ends where upon release of the ends, the nails pierce the sandpaper to hold the same in place.

Recent improvements in abrading implements have been made to meet the needs of the user. For example, it is desirable to minimize fatigue to the user while maintaining the effectiveness of the sanding block. The rubber material previously employed in these blocks was relatively rigid, dense and heavy and thus difficult for the user to pry apart and/or use for long period of time without fatigue. This is particularly true for woman in the do-it-yourself (DIY) market.

Applicant previously alleviated some of these problems. The applicant in U.S. Pat. No. 6,062,966 discloses a ribbed gripping surface and chamfered surface portions between the ends of a sanding block to aid in sanding. Also, U.S. Pat. No. 6,267,658 discloses a sanding block for hand held use wherein the sanding block has a base with a substantially flat bottom for receiving a sheet of sandpaper and a handle protruding from the top surface of the base, the handle having a front end and a back end designed to conform to the palm of a user.

While these changes have been helpful in gripping the implement and reducing fatigue, these products are relatively expensive to manufacture. There remains a need to provide an easy to use abrading implement in a cost effective manner.

The present invention overcomes other deficiencies of present abrading implements and method of making the same. The present invention also better meets the needs of present day consumer.

BRIEF SUMMARY OF THE INVENTION

It is an object to improve abrading implements.

It is another object to enhance the ease of use of abrading implements while maintaining effectiveness of the same in a cost efficient manner.

It is also an object to provide a relatively inexpensive abrading implement with a method of making the same.

Accordingly, one aspect of the present invention is directed to a method of making an abrading implement. The method includes the steps of disposing a porous member for aiding in abrasion adjacent a first surface within a mold and supplying two reactive liquid components into the mold in a manner in which the two materials enter onto a second surface of the mold opposing the first surface, whereupon a reaction between the components form a raw implement of structural foam which is bonded to the porous member. Subsequent to the reaction, the raw implement is removed from the mold and cut, preferably sawn, in a manner to provide an abrasive implement having a surface portion the foam exposed from the cut to aid in gripping the same by one's hand.

The mold is preferably elongated and configured to enable the formation of a plank-like raw implement and can have opposing flat surfaces, arcuate surfaces or a combination thereof in one embodiment, a flat surface has the porous member adjacent thereto and opposes an accurate surface to receive the liquid components. Preferably, the plank-like raw implement can be cross cut in a manner to leave two sides of the inner core exposed which enable one's fingers and thumb of a hand to contact opposing exposed inner core sides.

The method further includes providing the components in amounts such that a chemical reaction between the two components only permeates a portion of the porous member through a surface facing the components as they react. In a preferred embodiment, the liquids include a polyol and an isocyante which can be metered, blended together, and injected into the mold at low pressure to form a polyurethane structural foam. Typically, the foam part contacting the mold results in dense durable skin and the inner core remains a lower density cellular core. The amount of blend of materials determines the amount of rigidity to the implement.

The porous material can be a sheet member of a hook and loop Velcro material. After forming, an abrasive material, such as a sandpaper sheet, having a complementary sheet member of the hook and loop material on a backing thereof, can be fastened to the other loop member to provide an abrasive implement. Alternatively, the porous material can be a non-woven scrubbing material.

Other objects and advantages will be readily apparent to those skilled in the art upon viewing the drawings and reading the detailed description hereafter.

DETAILED DESCRIPTION OF THE INVENTION

Figure 1:
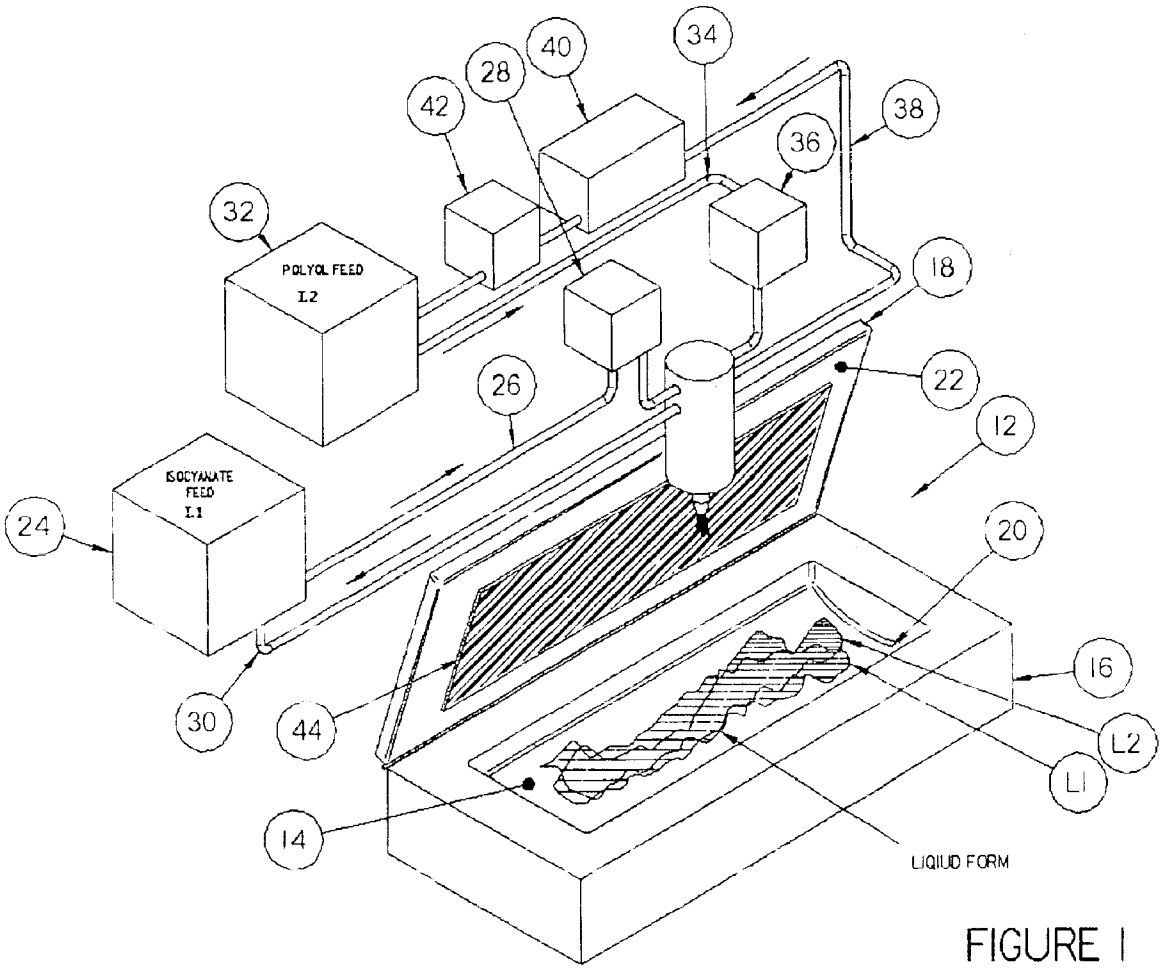
FIG. 1 is a perspective schematic showing one phase of the formation of an implement for use in abrading of the present invention.

Referring now to the drawings in FIGS. 1–6, the abrading implement of the present invention is generally referred to by the numeral 10. The abrading implement 10 is formed via a molding process, preferably using Reaction Injection Molding (or RIM). The process is one in which two reactive liquid components, a polyol and an isocyante, for example are metered, blended together, and injected into a closed mold at low pressure.

Figure 2A:
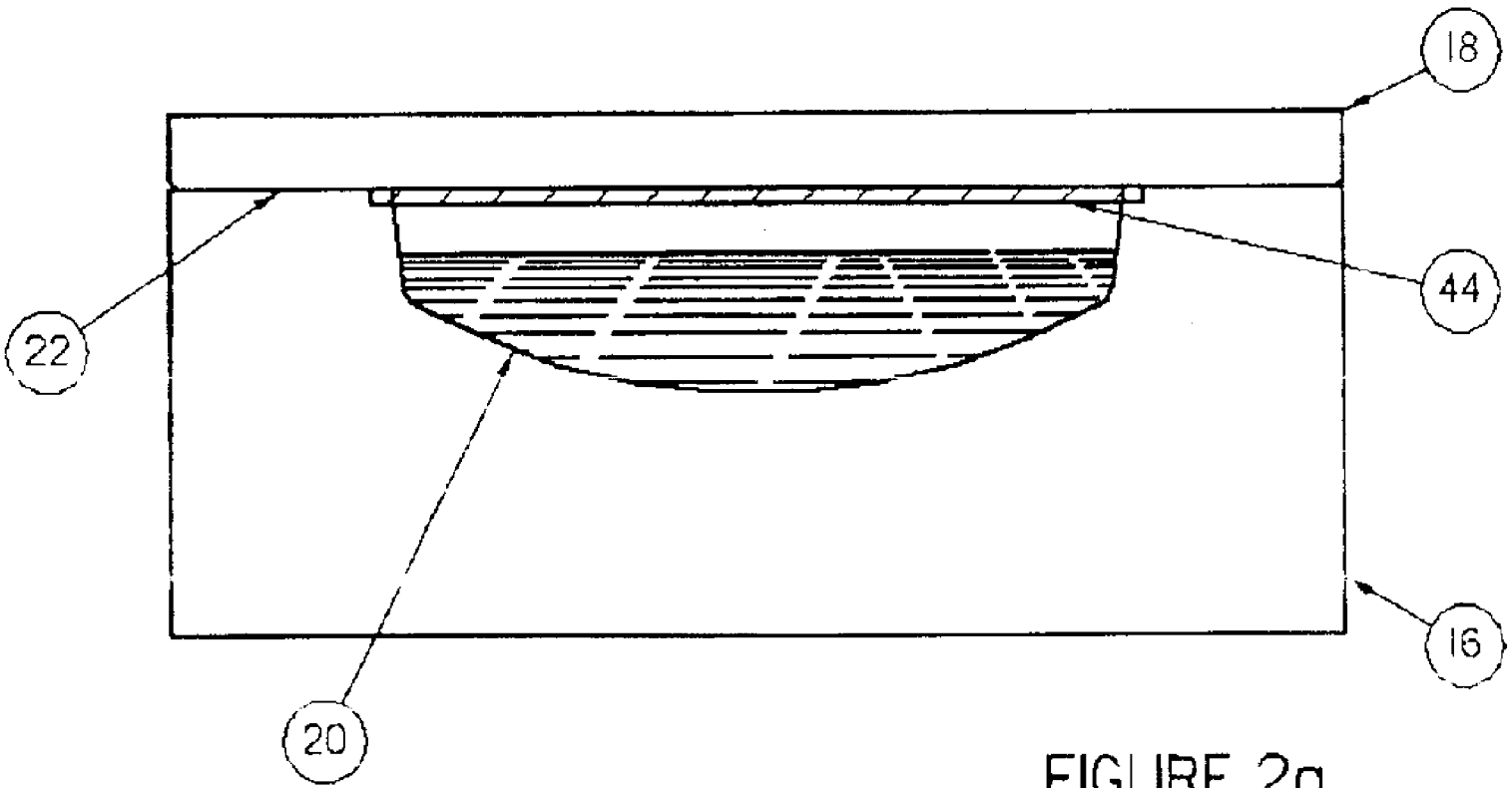
FIG. 2*a* is a cross-section showing another phase of the formation of an implement for use in abrading of the present invention.
Figure 2B:
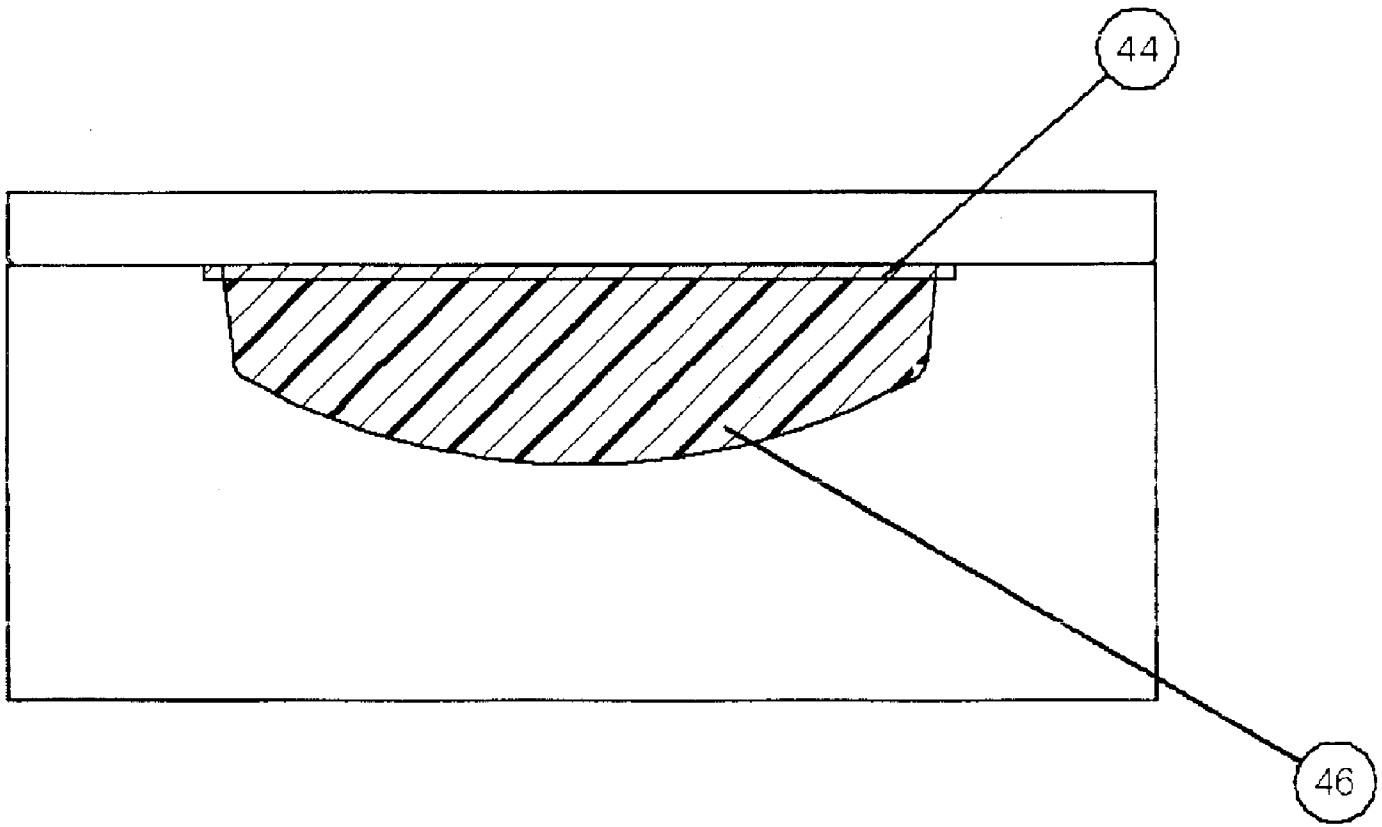
FIG. 2*b* shows a cross section of yet another phase of the formation of an implement for use in abrading of the present invention.
Figure 2C:
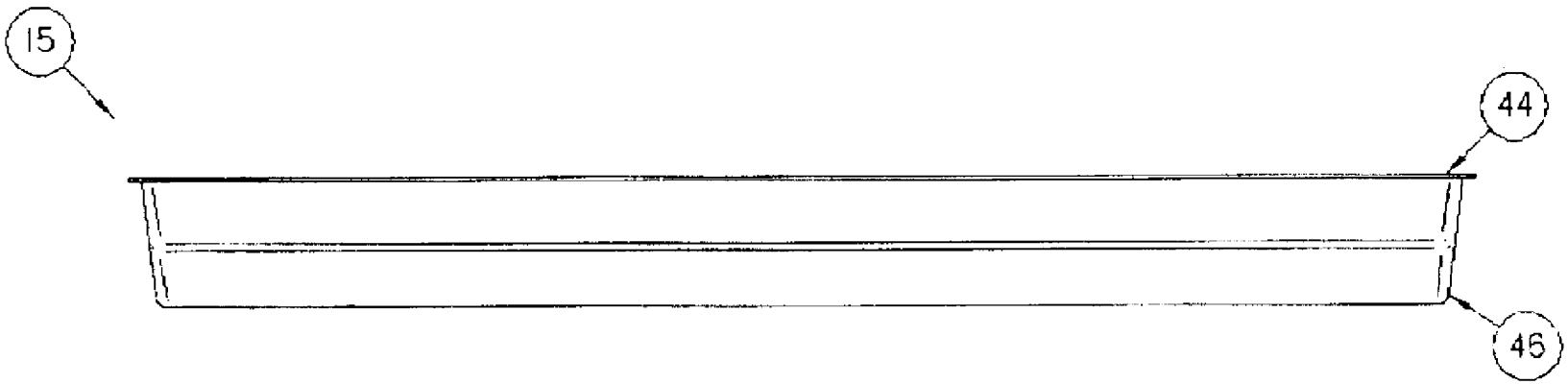
FIG. 2*c* shows a side view of a raw plank formed in a process of making the implement.
Figure 3A:
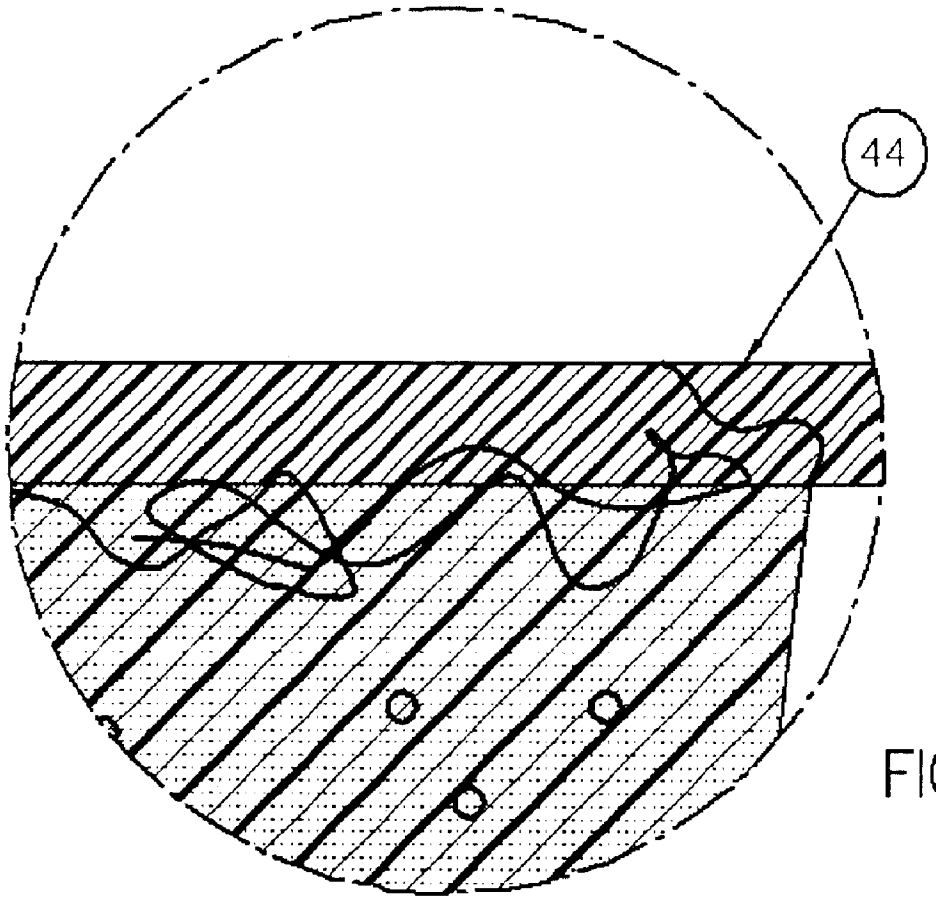
FIG. 3*a* shows and enlarged view of a portion of implement in FIG. 3*b*.
Figure 3B:
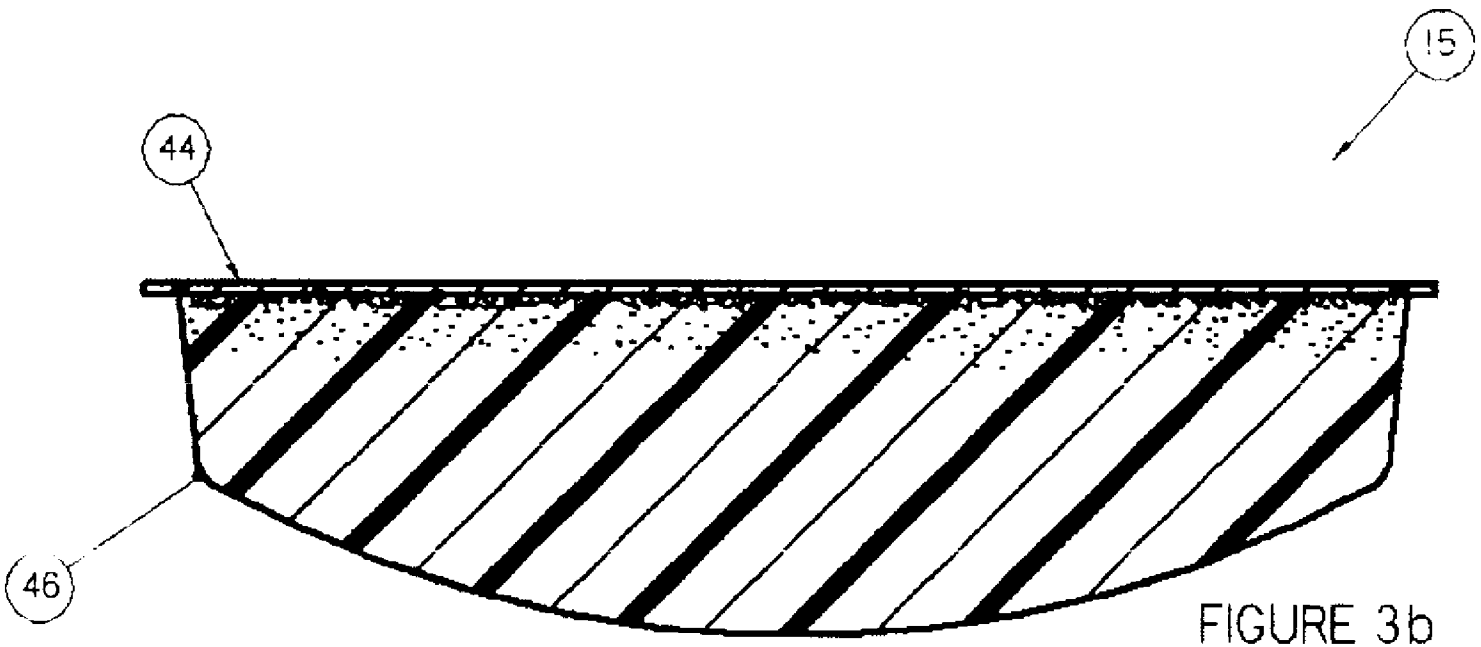
FIG. 3*b* shows a cross section of a raw form of the implement.
Figure 4:
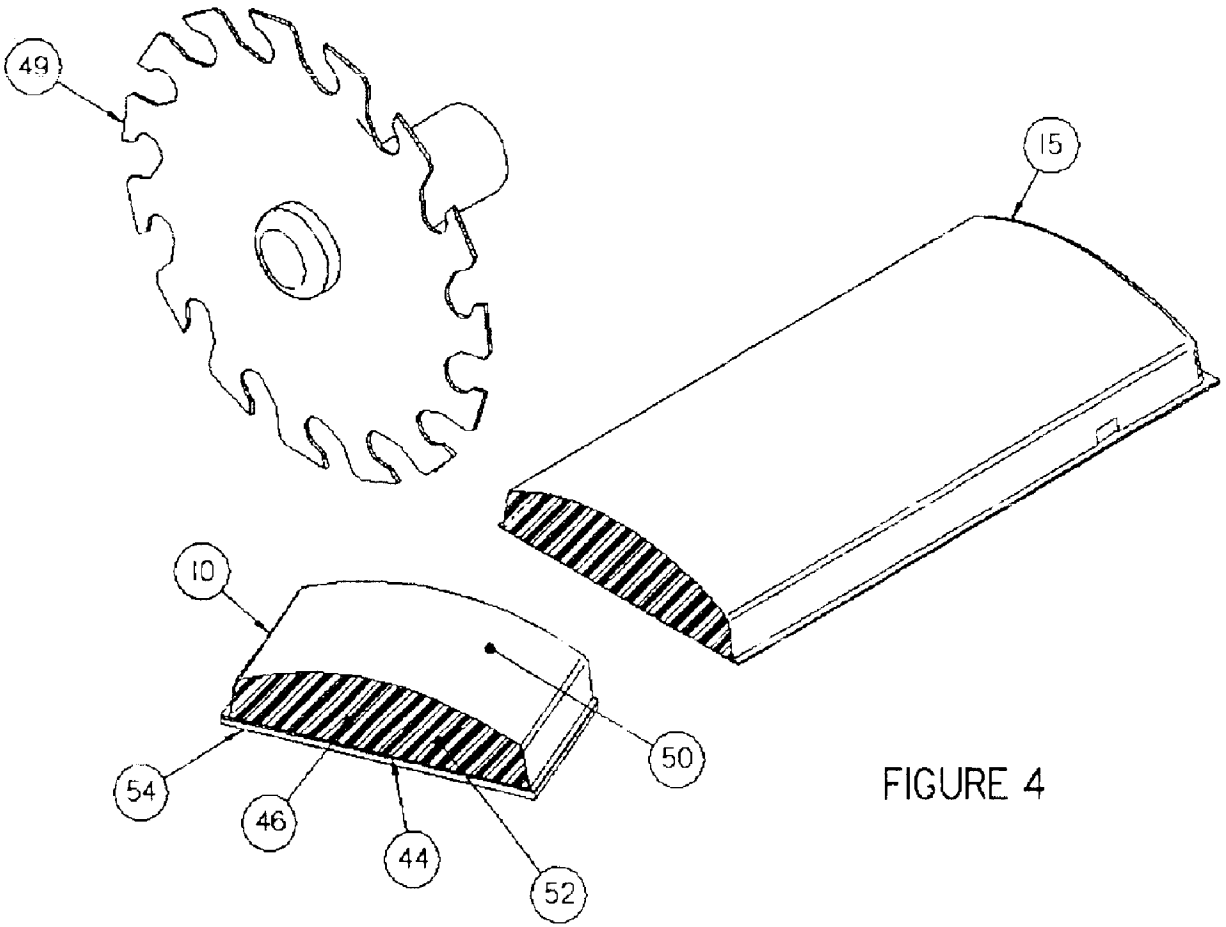
FIG. 4 is a schematic showing another part of the formation of an abrading implement of the present invention.

Here, the present invention uses a mold 12 configured with a cavity 14 capable of forming a plank-like raw abrading implement 15 as seen in FIGS. 2*c* and 4. The mold 12 includes a bottom 16 and a top 18 which include inner opposing surfaces 20 and 22, respectively, which collectively form the cavity 14. The mold 12 is relatively elongated to enable further processing of the raw implement 15 in order to provide multiple finished abrading implements 10 from the raw implement 15. The surfaces 20 and 22 can include a flat surface, an arcuate surface or a combination thereof. In the case of forming a sanding block, it is preferably to have one surface flat and another arcuate as seen in FIG. 1.

The mold 12 is operatively connected to a feed tank 24 including one liquid component L1, e.g., isocyante, via feed lines 26, pump 28 and return line 30. The mold 12 is also operatively connected to another feed tank 32 including another liquid component L2, e.g., polyol, via a feed lines 34, pump 36, return line 38, exchanger 40 and nucleator 42.

The method includes the steps of disposing a porous member 44 for aiding in abrasion adjacent the surface 22 within the mold 12 and supplying two reactive liquid components L1 and L2 from feed tanks 24 and 32 into the mold 12 in a manner in which the two materials enter onto surface 20. The surface 20 can be arcuate, for this example, and oppose surface 22. Partial formation is seen in cross section view of FIG. 2*a*. Upon a reaction between the components L1 and L2, a raw implement of structural foam 46 is formed which is bonded to the porous member 44 as seen in FIGS. 2*b* and 2*c*. The method of making the abrading implement 10 can include amounts of the two components L1 and L2 to aid in the control of a chemical reaction such that the components L1 and L2 only permeate a portion of the porous member 44 through a surface facing the components as they react. In a preferred embodiment, the liquids include a polyol and an isocyante which can be metered, blended together, and injected into the mold 12 at low pressure to form the polyurethane structural foam. Typically, the foam part contacting the mold 12 results in an exposed outer dense durable skin and an inner unexposed less dense core. The percentage of materials determines the amount of rigidity to the implement 10. Subsequent the reaction, the raw implement 15 is removed from the mold 12 and cut, preferably sawn in a cross-cut manner with radial saw 49 as seen in FIG. 4., to provide the abrasive implement 10 having an arcuate surface portion 50 to adapt to one's palm, two side surface portions 52 wherein an inner soft core of the foam 46 is exposed from the cut to aid in gripping the same by one's hand. This is important, as the outer exposed dense skin which results in the formation process is hard and smooth and more difficult to grip than the rough cut inner core which is exposed and is softer and by virtue of the cut provides greater friction to better aid in gripping.

Figure 5:
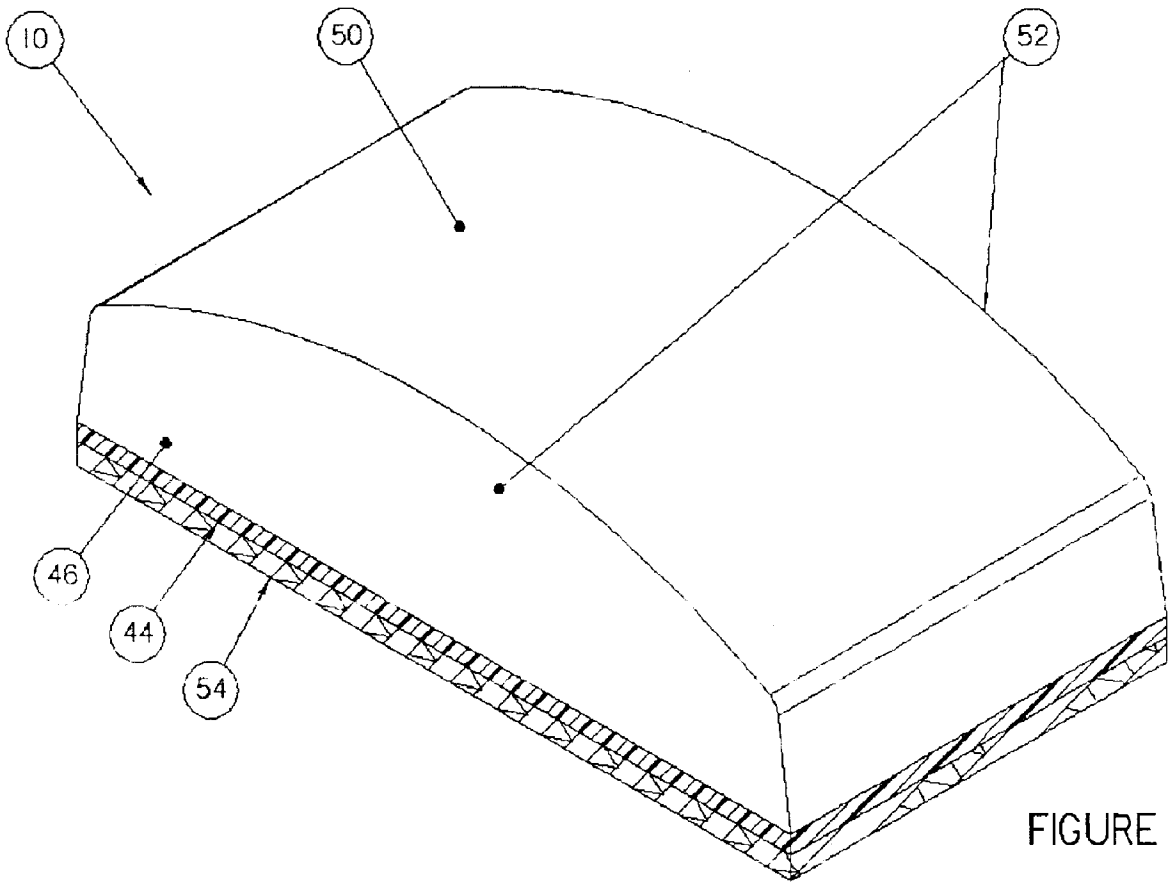
FIG. 5 is a perspective view of an abrading implement formed by the present invention with one type of abrading surface.
Figure 6:
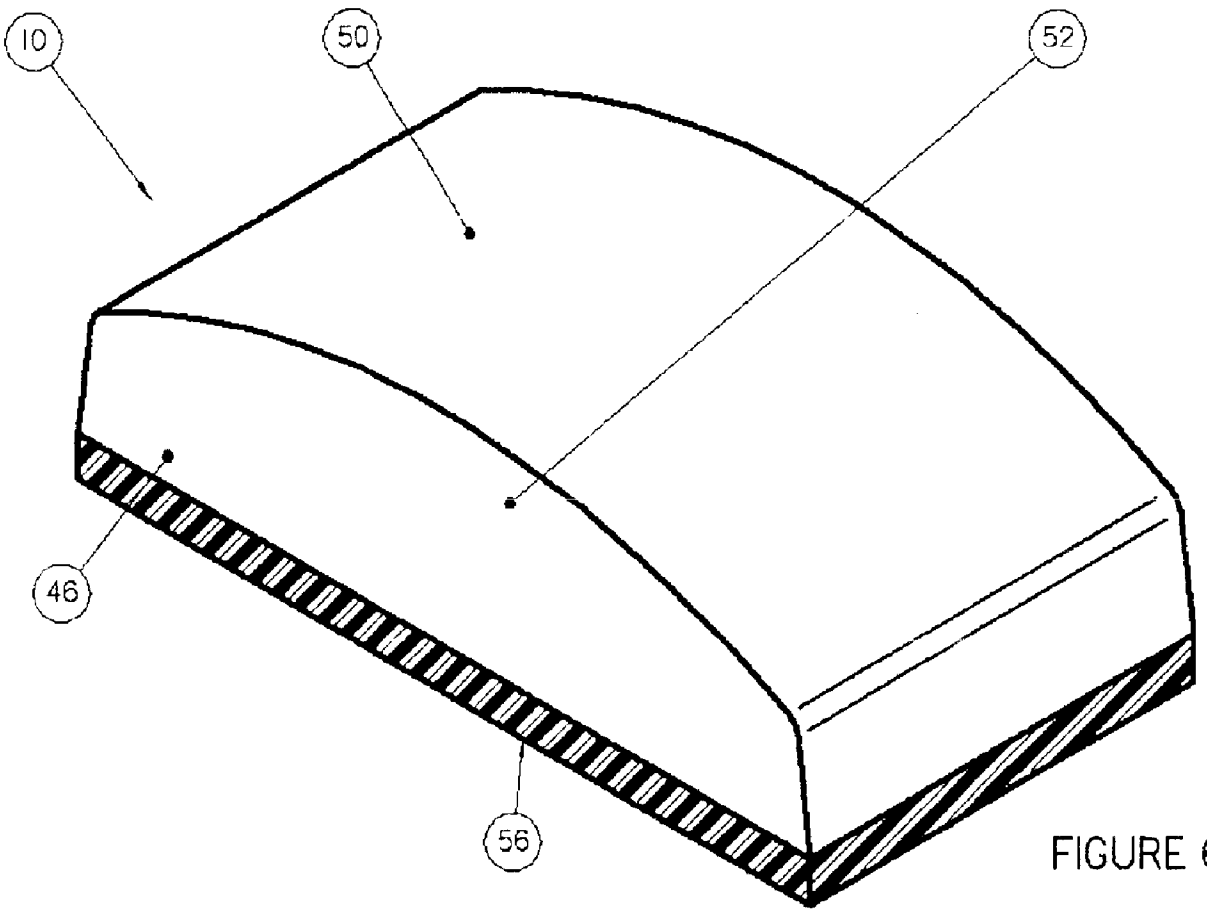
FIG. 6 is a perspective view of an abrading implement formed by the present invention with another type of abrading surface.

The porous member 44 can be made of a sheet member of a hook and loop Velcro material. After forming, an abrasive material, such as a sandpaper sheet 54, having another complementary sheet member of the hook and loop Velcro on a backing thereof, can be fastened to the loop member to provide an abrasive implement as seen in FIG. 5. Alternatively, the porous material can be a non-woven scrubbing material 56 as seen in FIG. 6.

The material characteristics of the abrading implement 10 described have desirable attributes of touch and feel for handling by the user as well as aiding to perform certain objectives herein. It is recognized that other materials may be employed to provide such attributes. Preferably, the invention is molded into a bonded structure which is preferably made of a polymeric material, e.g., a polyurethane foam, and subjected to a rough cut on opposing sides to provide a block shape capable of being used by a single hand.

The abrading implement 10 shown is exemplary of that contemplated by the inventor and it is contemplated that it may contain a design changes to facilitate a particular use of the implement, such changes in shape. By so providing, the instant invention enables the manufacture of an improved abrading implement which offers a desirable touch and feel and which is more cost effective than previously available.

The above described embodiments are set forth by way of example and are not for the purpose of limiting the present invention. It will be readily apparent to those skilled in the art that obvious modifications, derivations and variations can be made to the embodiments without departing from the scope of the invention. Accordingly, the claims appended hereto should be read in their full scope including any such modifications, derivations and variations.

What is claimed is:

1. A method of making an implement for use in abrading, which includes the steps of:

(a) disposing a porous member for aiding in abrasion adjacent a first surface of a mold;

(b) supplying two reactive liquid components into said mold in a manner in which said two reactive liquid components enter onto a second surface of said mold opposing said first surface, where upon a reaction taking place between said two reactive liquid components forms a raw implement of structural foam having an outer exposed dense durable skin and an inner unexposed less dense cellular core, said raw implement of structural foam being bonded to said porous member;

(c) removing said raw implement of structural foam from said mold; and (d) cutting said raw implement of structural foam in a manner to provide a finished abrasive implement having a surface portion of said less dense cellular core foam exposed from said cutting to aid in gripping said surface portion by one's hand.

2. The method of claim 1, wherein said mold is characterized to be elongated and configured to form a plank-like raw implement and having one of opposing flat surfaces, opposing arcuate surfaces, and opposing flat and arcuate surfaces.

3. The method of claim 2, said plank-like raw implement is cross cut in a manner to leave two sides of said inner core exposed which enable one's fingers and thumb of a hand to contact said opposing exposed inner core sides and hold said implement.

4. The method of claim 1, which further includes providing said components in amounts such that a chemical reaction between said two components only permeates a portion of said porous member through a surface facing said components upon said reaction.

5. The method of claim 1, wherein said liquids components include a polyol and an isocyante to form a polyurethane structural foam.

6. The method of claim 1, wherein said porous material includes a sheet member of a hook and loop Velcro material.

7. The method of claim 6, which further includes the step after removing of applying a complementary sheet member of said hook and loop Velcro having an abrasive material on a backing thereof to provide an abrasive implement.

8. The method of claim 1, wherein said porous material is a non-woven scrubbing material.

9. An abrading implement as made in claim 1.

10. The abrading implement of claim 9, which has two sides of said inner core exposed from said cutting which enable one's fingers and thumb of a hand to contact said opposing exposed inner core sides.

11. The abrading implement of claim 9, wherein said raw implement of structural foam is a polyurethane structural foam.

12. The abrading implement of claim 9, wherein said porous material includes a sheet member of a hook and loop Velcro material and a complementary sheet member of said hook and loop Velcro having an abrasive material on a backing thereof to provide an abrasive implement.

13. The abrading implement of claim 9, wherein said porous material is a non-woven scrubbing material.

* * * * *